US010692626B2

(12) United States Patent
Fallahmohammadi et al.

(10) Patent No.: US 10,692,626 B2
(45) Date of Patent: Jun. 23, 2020

(54) ELECTRIC CABLE WITH CORROSION RESISTANT ARMOR

(71) Applicant: PRYSMIAN S.p.A., Milan (IT)

(72) Inventors: Ehsan Fallahmohammadi, Milan (IT); Flavio Casiraghi, Milan (IT)

(73) Assignee: PRYSMIAN S.p.A., Milan (IT)

( * ) Notice: Subject to any disclaimer, the term of this patent is extended or adjusted under 35 U.S.C. 154(b) by 0 days.

(21) Appl. No.: 15/775,407

(22) PCT Filed: Nov. 13, 2015

(86) PCT No.: PCT/EP2015/076580
§ 371 (c)(1),
(2) Date: May 11, 2018

(87) PCT Pub. No.: WO2017/080621
PCT Pub. Date: May 18, 2017

(65) Prior Publication Data
US 2018/0330846 A1 Nov. 15, 2018

(51) Int. Cl.

| | |
|---|---|
| ***H01B 7/18*** | (2006.01) |
| ***H01B 7/04*** | (2006.01) |
| ***C23C 2/12*** | (2006.01) |
| ***H01B 7/22*** | (2006.01) |
| ***H01B 7/28*** | (2006.01) |
| ***C23C 2/38*** | (2006.01) |

(52) U.S. Cl.
CPC ..... *H01B 7/046* (2013.01); *C23C 2/12* (2013.01); *C23C 2/38* (2013.01); *H01B 7/226* (2013.01); *H01B 7/2806* (2013.01)

(58) Field of Classification Search
CPC ..... H01B 7/18; H01B 9/025
USPC ..... 174/106 R, 126.2
See application file for complete search history.

(56) References Cited

U.S. PATENT DOCUMENTS 3,299,202 A 1/1967 Brown
4,096,351 A 6/1978 Wargin et al.
(Continued)

FOREIGN PATENT DOCUMENTS

EP 0924711 A2 6/1999
EP 1380666 A1 1/2004
(Continued)

OTHER PUBLICATIONS

Saakiyan, L. et al., "*Prediction of the Efficiency of Carbon Steel Protected by Aluminum or Aluminum-Oxide Coatings Under Hydrogen Sulfide Cracking*", Materials Science, vol. 29, No. 6, 1993, pp. 600-603.
(Continued)

*Primary Examiner* — Chau N Nguyen
(74) *Attorney, Agent, or Firm* — Oblon, McClelland, Maier & Neustadt, L.L.P.

(57) ABSTRACT

An electric cable (10) is disclosed comprising a) at least one cable core (11) comprising at least one power transmissive insulated element (12); and b) a metallic outer armor (19) containing the cable core (11); wherein the outer armor (19) comprises a carbon steel tape (20) wound according to helical interlocked windings, the tape (20) being coated with an aluminum coating layer (22) having a thickness equal to or lower than 50 μm. Furthermore, a process for manufacturing such an electric cable is disclosed.

11 Claims, 3 Drawing Sheets

(56) References Cited

U.S. PATENT DOCUMENTS

| | | | | | |
|---|---|---|---|---|---|
| 4,546,051 | A * | 10/1985 | Uchida | C23C 2/12 | 148/505 |
| 4,624,895 | A * | 11/1986 | Nickola | C23C 2/12 | 148/273 |
| 6,207,299 | B1 * | 3/2001 | Krauth | C23C 2/12 | 428/653 |
| 7,228,627 | B1 * | 6/2007 | Yoshimura | H01B 5/104 | 174/108 |
| 2002/0160230 | A1 * | 10/2002 | Yoshikawa | G11B 5/656 | 428/832 |
| 2004/0009366 | A1 | 1/2004 | Takagi et al. | | |
| 2017/0016086 | A1 * | 1/2017 | Sanadres | C21D 8/0278 | |

FOREIGN PATENT DOCUMENTS

| | | | |
|---|---|---|---|
| JP | 2008-255391 | A | 10/2008 |
| WO | WO 2011/146353 | A2 | 11/2011 |
| WO | WO 2015/004597 | A1 | 1/2015 |

OTHER PUBLICATIONS

International Search Report and Written Opinion dated Jul. 22, 2016 in PCT/EP2015/076580, filed Nov. 13, 2015.

* cited by examiner

ELECTRIC CABLE WITH CORROSION RESISTANT ARMOR

TECHNICAL FIELD

The present invention relates to an electric cable provided with a corrosion resistant armor.

More particularly, the invention relates to an electric cable which has a preferred though not exclusive use in adverse environmental conditions, such as those present in an oil well.

More particularly, embodiments disclosed herein relate to a cable that can provide power to a downhole pump, in which the cable has multiple layers and an outer armor for increased reliability in terms of corrosion resistance.

BACKGROUND OF THE INVENTION

In the oil and gas industry and as described, for example, in International patent application WO 2011/146353, a wide variety of systems are known for producing fluids from a subterranean formation.

Oil wells typically rely on natural gas pressure to propel crude oil to the ground surface. In formations providing sufficient pressure to force the fluids to the ground surface, the fluids may be collected and processed without the use of artificial lifting systems.

Oftentimes, particularly in more mature oilfields that have diminished gas pressure or in wells with heavy oil, this pressure is not sufficient to bring the oil out of the well. In these instances, the oil is pumped out of the wells using a pumping system.

At the present time, wide use is made of a pumping system including electrical submersible pumps (ESPs) disposed downhole within a well to pump the desired fluids to the ground surface. A submersible pump is usually deposited within the production fluids to then pump the desired fluids to the ground surface by generating a pressure boost sufficient to lift production fluids even in deep water subsea oil wells.

A submersible pumping system is disclosed by the above-mentioned WO 2011/146353 which states that, typically, the subterranean environment presents an extreme environment having high temperatures and pressures.

Temperatures of a subterranean environment can reach 200° C., and the pressures are of about 200-250 bar, but in some cases even up to 800 bar.

Further, fluids containing one or more corrosive compounds, such as carbon dioxide, hydrogen sulfide, and/or brine water, may also be injected from the surface into the wellbore (e.g., acid treatments). These extreme conditions can be detrimental to components of the submersible pumping system and particularly to the internal electrical components of the electric cable.

Specifically, electrical cables for submersible pumping systems typically contain a cable core comprising a metallic conductor (e.g., a copper conductor) and a polymer layer surrounding the metallic conductor which must be protected from the corrosive effects of the well fluids that surround the cable.

To protect the electrical cables, it is known in the art to provide an outer armor containing the cable core at a radially outer position with respect to the cable core itself.

Generally, this outer metal armor comprises a galvanized carbon steel tape wound according to short-pitch helical windings around the rubber protective sheath which surrounds the cable cores. The windings are engaged with each other by the fitting together of projections and recesses. This winding configuration is herein referred to as "interlocked".

In such a way, the outer metal armor aims at protecting the insulated conductors from impact and abrasion and at protecting the cable cores against corrosive compounds in the well, while maintain a flexibility suitable for the application.

The already mentioned WO 2011/146353 teaches to protect the electrical cables by providing the cable with at least one strength member layer bonded to the cable core, the at least one strength member layer comprising a plurality of polymer-bonded strength members. The material used for the strength members of the polymer-bonded strength members may be selected from galvanized improved plow steel of different carbon content, stainless steel, aluminum-clad steel, anodized aluminum-clad steel, high strength galvanized carbon steel and/or any other suitable strength material. The material used for the polymer material encompassing the polymer-bonded strength members may be selected from a modified polyolefin, for example, amended with one of several adhesion promoters.

International patent application WO 2015/004597 teaches to protect the carbon steel elongated elements (strips or tapes) of a mechanical armor structure of a submarine flexible pipe by coating these elongated elements with an aluminum cladding.

According to this reference, the aluminum cladding of each of the elongated elements preferably has a thickness not lower than about 250 μm, more preferably of between about 250-900 μm so as to have an expected pipe working life greater than 20 years, up to 40 years.

The aluminum cladding is applied by any of the following processes: immersion in melted aluminum, coating with aluminum thin foil, flame and/or plasma spraying, aluminum extrusion.

Saakiyan, L. S. et al., Materials Science, Vol. 29, No. 6, 1993, p.600 discloses a model for describing the decrease in tensile strength of carbon steel specimens under the action of an hydrogen sulfide environment.

According to this reference, aluminum and aluminum-oxide coatings considerably increase the conventional limit of hydrogen sulfide cracking of steel parts and their operating lifetime. More specifically, coating steel with aluminum is said to increase the conventional limit of hydrogen sulfide cracking by 3.5-4 times if the thickness of the aluminum layer is 50 μm. An increase in the thickness of the aluminum layer results in a further increase in the limit of hydrogen sulfide cracking.

SUMMARY OF THE INVENTION

The Applicant observed that in adverse environmental conditions, such as those present in an oil well, known outer metal armors of electric cables providing power to a downhole pump and made of interlocked galvanized carbon steel tapes are subject to heavy corrosion phenomena which considerably limit the cable working life despite the presence of the galvanized protecting layer.

In some instances, the rate of corrosion of the outer metal armor due to the acidic environment including hydrogen sulfide is so fast that cable failure may occur in 100 days or so.

Additionally, the Applicant observed that corrosion of the outer metal armor made of an interlocked galvanized carbon steel tape in this acidic environment results in fouling and/or contaminating the wellbore.

When the cable and/or pump fail electrically, it/they must be brought to the surface and repaired or replaced. This is extremely time-consuming and expensive, as usually the entire pipe string must be brought up to the ground to extract the submersible pump and the related cable.

In connection with the submarine flexible pipe armor structure, the above mentioned WO 2015/004597 suggests a minimum thickness of about 250 μm of the aluminum coating of the elongated elements of such a structure.

The Applicant observes that such a thickness is not compatible with the mechanical deformation operations required to shape and wind the carbon steel tape so as to form the interlocked outer metal armor of a cable for downwell use.

Also, a relatively high minimum thickness brings an undesired increase of the coated steel tape size and weight. Power cables operating in an oil well should have minimized dimensions because of the limited space of this operation environment. Moreover, the weight plays an important role in the selection of a cable for oil well, as these cables often operate vertically, possibly suspended or attached to other well structures which can also move in use.

The Applicant considered the problem of avoiding, or at least considerably reducing, the hydrogen sulfide corrosion phenomena in an electrical cable for use in adverse environmental conditions, such as those present in an oil well, and provided with an outer metal armor made of interlocked carbon steel tape not embedded in any polymer matrix and thus directly exposed to this adverse environment.

The Applicant found that a steel tape armor of an electric cable for downwell use can withstand the environmentally challenging operating conditions, especially the hydrogen sulfide corrosion, even when provided with a relatively thin protecting aluminium coating layer.

The protecting aluminium coating layer should be as thin as possible to keep the cable dimensions limited. Also, the aluminium coating layer should be substantially without defect or detachment for ensuring a safe steel protection against corrosion during the whole cable operation life.

Accordingly, the present invention relates to an electric cable comprising:

- a cable core comprising a power transmissive insulated element; and
- a metallic outer armor containing the cable core;

wherein the outer armor comprises a carbon steel tape wound according to helical interlocked windings, the tape being coated with an aluminum coating layer having a thickness equal to or lower than 50 μm.

According to a second aspect thereof, the present invention relates to a process for manufacturing an electric cable comprising:

- a cable core comprising a power transmissive insulated element; and
- a metallic outer armor containing the cable core;

wherein the outer armor comprises a carbon steel tape wound according to helical interlocked windings, the tape being coated with an aluminum coating layer having a thickness equal to or lower than 50 μm; the process comprising:

- producing a flat carbon steel tape;
- dipping the flat carbon steel tape in melted aluminium to obtain a flat aluminium coated steel tape;
- shaping the flat aluminium coated steel tape at room temperature; and
- winding and interlocking the flat aluminium coated steel tape around the cable core.

Throughout the present description and in the subsequent claims, the term "cable core" is used to indicate a semi-finished structure comprising a transmissive element, such as an electrical conductor, and an electrical insulating system comprising an insulating layer and, optionally, a semi-conductive layer in radially outer position with respect to the electric conductor.

Throughout the present description and in the subsequent claims, the term "conductor" means an electrical conducting element of elongated shape and preferably of a metallic material.

Throughout the present description and in the subsequent claims, the expressions "radially inner" and "radially outer" are used to indicate a closer and far position, respectively, along a radial direction with respect to a longitudinal axis of the cable.

Throughout the present description and in the subsequent claims, the term "carbon steel" is used to indicate a steel or steel alloy selected because of its mechanical properties and is not expected to provide per se a significant corrosion resistance in adverse environmental conditions, such as those present in an oil well.

Within the framework of the present description and in the subsequent claims, all numbers expressing amounts, quantities, percentages, and so forth, are to be understood as being preceded in all instances by the term "about" except where otherwise indicated. Also, all ranges of numerical entities include all the possible combinations of the maximum and minimum numerical values and all the possible intermediate ranges therein, in addition to those specifically indicated hereinbelow.

The Applicant found that an aluminium coating layer with a thickness equal to or lower than 50 μm is capable of imparting the desired hydrogen sulfide corrosion and cracking resistance to the steel tape as required to operate in a downwell environment.

The armor of the cable of the invention which comprises a carbon steel tape coated with an aluminum layer having a thickness equal to or lower than 50 μm, has reduced weight, size and cost.

The electric cable of the invention can have at least one of the preferred features which follow.

Preferably, the steel tape of the armor of the invention is advantageously wound according to short pitch helical interlocked windings.

Throughout the present description and in the subsequent claims, the term "short pitch" is used to indicate that the helical windings of the steel tape of the outer armor form a winding angle between 70° and 90°, preferably of about 90°, with respect to the longitudinal axis of the armor, i.e. of the cable.

The cable of the present invention may be a round cable or a flat cable.

Throughout the present description and in the subsequent claims, the term "flat cable" is used to indicate a cable comprising at least two cores disposed in planar configuration, where all the cores lie substantially parallel to each other in a common plane. In a section of a flat cable transversal with respect to the lengthwise direction of the same cable, the cores lie substantially aligned to a common transversal axis.

The aluminum coating layer preferably has a thickness of from 20 μm to 45 μm.

The aluminum coating layer is advantageously continuously bonded to the interlocked carbon steel tape of the cable of the invention.

As used herein, the term "continuously bonded" refers to an aluminium coating which is substantially completely bonded to and adhering to the carbon steel tape along the whole extension thereof without leaving carbon steel tape portions directly exposed to the external environment.

Without wishing to be bound to a theory, an intermetallic compound formed at an interface between the steel tape and the aluminum coating layer is thought to provide such a continuous bonding.

In a preferred embodiment, therefore, the cable of the present invention comprises an Al—Fe intermetallic compound at the interface between the steel tape and the aluminum coating layer.

This intermetallic compound can be formed during the coating process of the steel tape as disclosed herein.

Preferably, the aluminium coating layer of the carbon steel tape of the outer armor of the cable of the invention includes silicon.

In a preferred embodiment, the cable of the present invention comprises an intermetallic compound comprising iron, aluminium and silicon (Fe—Al—Si) at the interface between the steel tape and the aluminum coating layer This intermetallic compound can be formed during the coating process of the steel tape as disclosed herein.

The Applicant found that an intermetallic compound which comprises Al—Fe or Fe—Al—Si advantageously promotes the adhesion of the aluminium coating layer to the carbon steel tape so that the aluminum coating layer does not detach from the steel tape during the corrugation or bending operations of the steel tape.

An intermetallic compound comprising Fe—Al—Si proved particularly effective in providing a continuous bonding of the aluminum coating layer to the carbon steel tape of the cable armor.

More preferably, the aluminum coating layer comprises from 5 to 15% by weight of Si on the total weight thereof.

In a preferred embodiment, the Fe—Al—Si intermetallic compound has the following formula:

$$Al_xSiFe_y$$

wherein x is a number comprised between 3 and 7 and y is a number comprised between 1 and 3.

Most preferably, the Fe—Al—Si intermetallic compound has the following formula:

$$Al_{5.3}SiFe_{1.5}$$

Preferably, the Al—Fe or Fe—Al—Si intermetallic compound is included within an interface layer having a thickness of at least 2 μm and of 7 μm at most.

Preferably, the carbon steel tape of the outer cable armor has a thickness of between 550 μm and 750 μm (aluminium coating excluded).

Preferably, the carbon steel is mild steel having a carbon content of from 0.05 to 0.15% by weight on the total weight of the steel.

Preferably, the carbon steel is a mild steel having type D globular inclusions according to ASTM E45-11a.

Throughout the present description and in the subsequent claims, the term "inclusions" is used to indicate chemical compounds and nonmetal that are present in the steel alloy as a consequence of chemical reactions, physical effects, and contamination that occurs during the melting and pouring process.

Typical examples of inclusions are sulfides, such as FeS, MnS, $Al_2S_3$, CaS, MgS, $Zr_2S_3$, nitrides, such as ZrN, TiN, AlN, CeN; silicates and oxides, such as FeO, MnO, $Cr_2O_3$, $SiO_2$, $Al_2O_3$, $TiO_2$, $FeO.Fe_2O_3$, $FeO.Al_2O_3$, $FeO.Cr_2O_3$, $MgO.Al_2O_3$, $2FeO.SiO_2$.

Most advantageously, the use of a low-cost steel of this kind, properly protected by the aluminium coating, allows to reduce the cost of the outer armoring of the cable thereby lowering the overall cost of the cable itself.

In a preferred embodiment, the mild steel comprises 0.001 to 0.015% by weight of carbon (C), 0.05 to 0.3% by weight of silicon (Si) and 0.1 to 0.6% by weight of manganese (Mn).

The carbon steel tape can be manufactured by a process comprising a hot rolling step, optionally a pickling step, and a cold rolling step to attain the desired thickness of the tape and to provide a flat tape with the desired mechanical properties.

The flat carbon steel tape is then coated with an aluminium layer.

In a preferred embodiment, the aluminum coating layer is applied on the surfaces of the flat carbon steel tape by hot dip coating, i.e. by immersion in melted aluminum, preferably an aluminum containing silicon as defined above.

Preferably, the coating step is preceded by a step of heat treatment of the carbon steel tape.

Preferably, degreased rolled steel tapes are heat treated in a reducing atmosphere of nitrogen and hydrogen (30%) having a dew point of −40° C. at a temperature of from 800° C. to 850° C.

Preferably, the heat treated steel tapes are cooled to a temperature of from 600° C. to 700° C. and soaked for a time of from 0.5 to 2 hours.

Preferably, the coating step is carried out by dipping the heat treated steel tapes in a coating bath containing aluminium.

Preferably, the coating step is followed by a step of equalizing the thickness of the aluminium coating deposited on the surfaces of the steel tape.

Preferably, the equalizing step is carried out by gas wiping using known techniques.

Preferably, the equalizing step is followed by a step of slow cooling.

Preferably, the cooling step is carried out by leaving the Al-coated steel tape in calm air.

The flat aluminium coated steel tape is then bent to the desired shape. Preferably, the tape bending is performed at room temperature.

Throughout the present description and in the subsequent claims, the term "room temperature" indicates a temperature between 15 and 35° C.

Manufacturing an outer armor having the desired mechanical characteristics can be made by the usual operations of plastic deformation required to shape the tape and then to wind and interlock the shaped tape.

BRIEF DESCRIPTION OF THE FIGURES

Additional features and advantages of the present invention will appear more clearly from the following detailed description of a preferred embodiment thereof, such description being provided merely by way of non-limiting example and being made with reference to the annexed drawings. In such drawings.

DETAILED DESCRIPTION OF THE CURRENTLY PREFERRED EMBODIMENTS

In the following detailed description of preferred embodiments of the present disclosure, numerous specific details are set forth in order to provide a more thorough understanding of the claimed subject matter.

However, it will be apparent to one of ordinary skill in the art that the preferred embodiments disclosed herein may be practiced without these specific details. In other instances, well-known features have not been described in detail to avoid unnecessarily complicating the description.

The preferred embodiments disclosed herein relate to a cable 10 for use with a downhole pump. The downhole pump may be any pump known in the art, such as an electrical submersible pump.

As such, a cable 10 of the present disclosure may be capable of better withstanding long-term exposure to the severe environment encountered downhole, in particular the exposure to an aqueous medium comprising hydrogen sulfide and carbon dioxide dissolved therein.

Accordingly, as from FIGS. 1-4, a cable 10 is provided with an outer armor 19 comprising a interlocked carbon steel tape comprising an aluminium coating 22 (shown in FIG. 5) that is continuously bonded.

Figure 1:
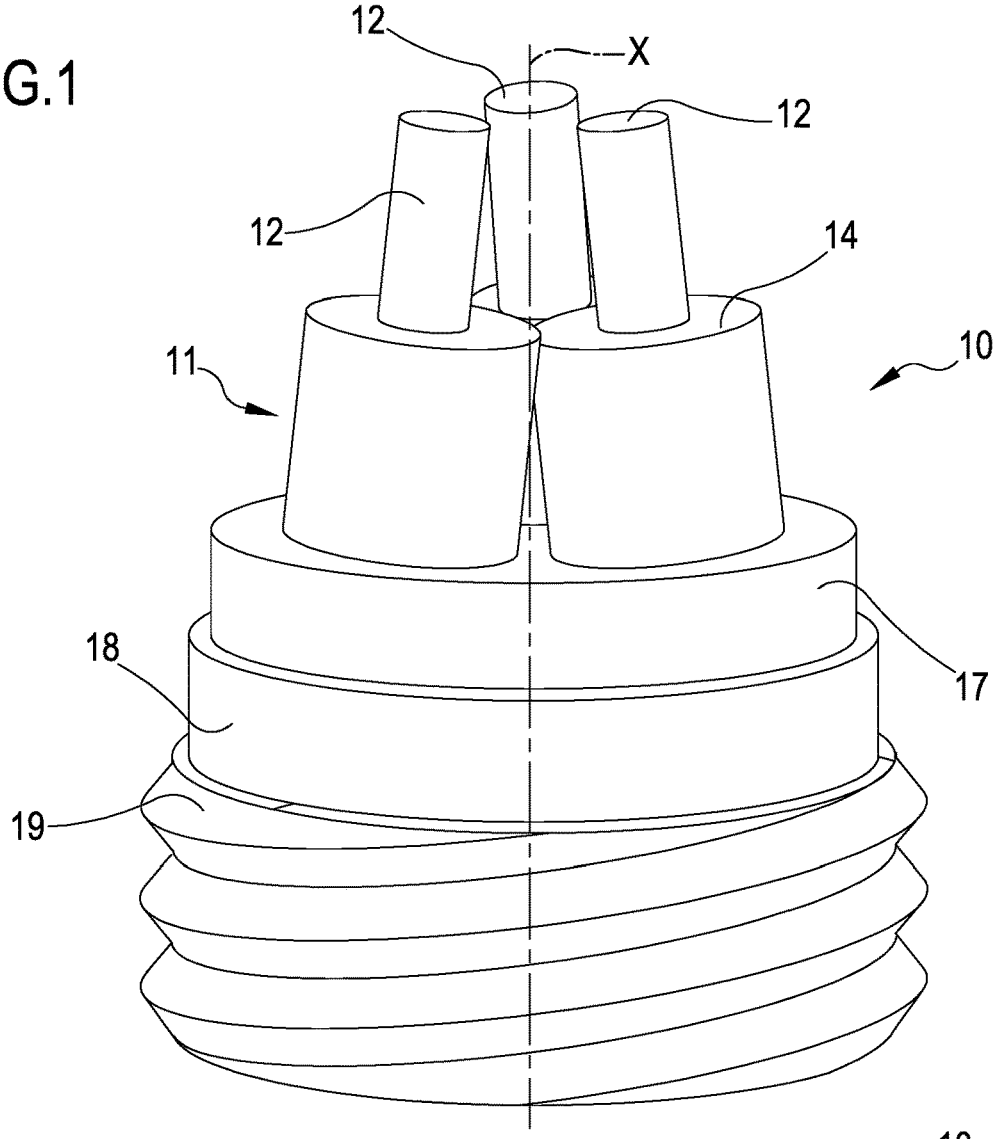
FIG. 1 shows a schematic perspective view of an electric cable according to a first preferred embodiment of the invention.
Figure 2:
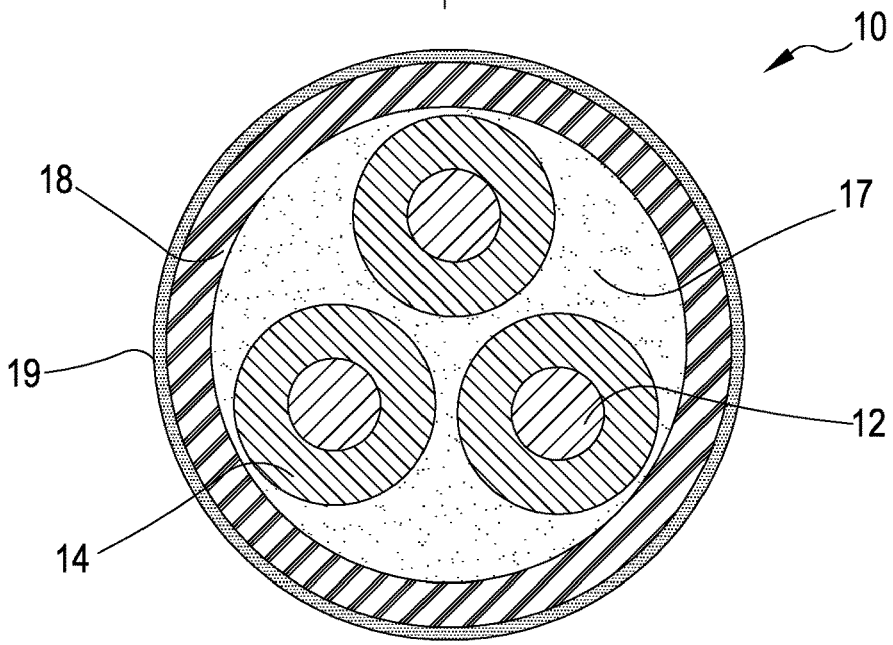
FIG. 2 is a cross-sectional view of the electric cable of FIG. 1.

In FIGS. 1 and 2, a round electric cable 10 for use with a downhole pump 2 according to the present invention is shown.

The cable 10 extends along a longitudinal axis X-X.

The round cable 10 comprises three cores 11 each of which comprises one power transmissive element or conductor 12.

The present invention, however, could also deal with mono-polar or multi-polar cables, too.

The cable 10 can comprise additional cores with different transmissive elements too, such as optical transmissive elements or combined electro-optical transmissive elements (not shown).

Each cable core 11 comprises, in order from the centre outwards the conductor 12 and an insulating layer 14.

The material used for the conductor 12 for a cable 10 in accordance with the present disclosure may include any metallic electrically conducting material known in the art.

As such, a metallic conductor may include: solid copper or aluminium rod, stranded copper or aluminium wires, copper or aluminium clad steel wires, titanium clad copper wire, and/or any other conducting wire known in the art.

The insulating layer 14 comprises a polymeric base material known in the art and suitable for the purpose.

Preferably, the insulating coating layer 14 comprises polypropylene or ethylene propylene diene monomer (EPDM) synthetic rubber as a polymeric base material.

The cores 11 of the cable 10 are embedded within a filler 17 preferably made of a suitable polymeric material such as polyethylene.

The cable 10 preferably comprises at a radially outer position with respect to the filler 17 a protective sheath 18 made of any suitable material adapted to protect the cores 11 from mechanical damage.

Preferably, the protective sheath 18 can be made of a material selected from nitrile and EPDM rubber.

In the embodiment illustrated in the drawings, the outer armor 19 containing the cable cores 11 of the cable 10 is provided at a radially outer position with respect to the protective sheath 18.

Further protective layers (not illustrated) can be present in radial internal position with respect to the outer armor 19, according to specific application requirement. See, for example, http://petrowiki.org/ESP_power_cable.

Figure 5:
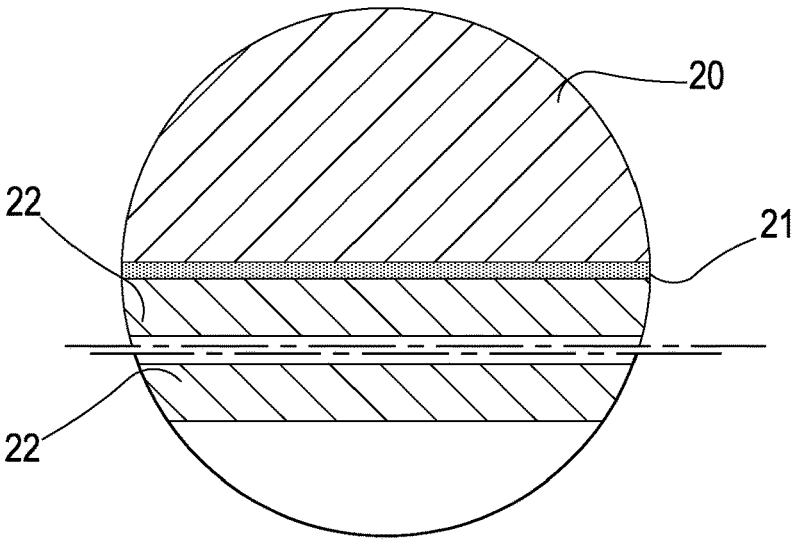
FIG. 5 is an enlarged scale detail of an outer portion of an outer armor of the electric cables of FIGS. 1-4 showing an intermetallic layer interposed between a steel tape forming the armor and an aluminium coating layer of the sheet.

As detailed in FIG. 5, the outer armor 19 can comprise a carbon steel tape 20 wound according to short-pitch helical interlocked windings and comprising an aluminum coating layer 22 applied on both the outer and the inner surfaces and, preferably, also on the edges thereof.

Preferably, the aluminum coating layer 22 comprises silicon.

An intermetallic layer 21 preferably made of an alloy which comprises a Fe—Al—Si intermetallic compound is formed at an interface between the steel tape 20 and the aluminum coating layer 22.

The round cable 10 according to the present disclosure can be made by any known techniques for the deposition of layers of suitable materials.

Figure 3:
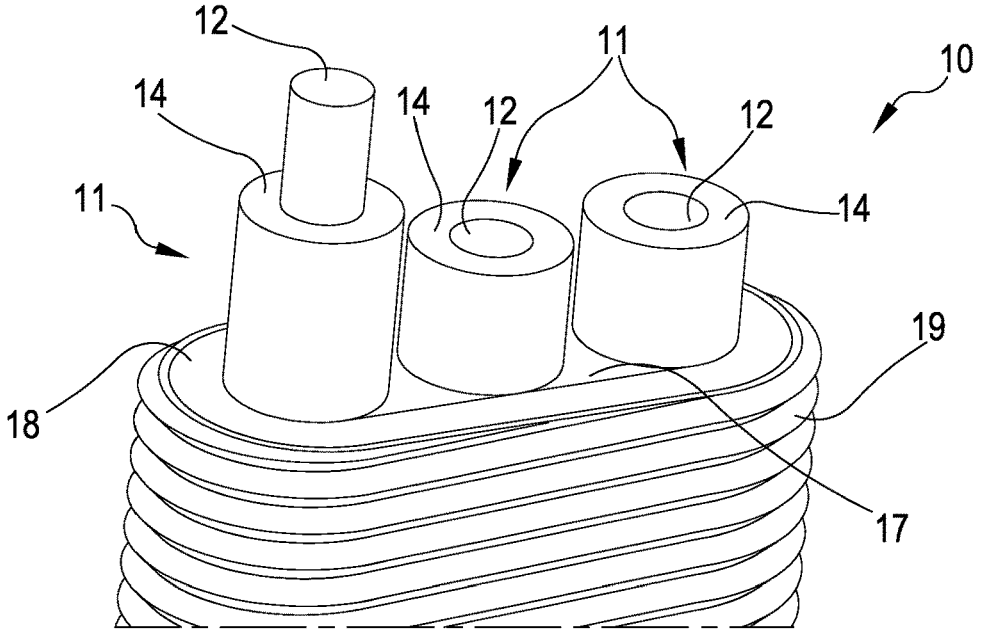
FIG. 3 shows a schematic perspective view of an electric cable according to a second preferred embodiment of the invention.
Figure 4:
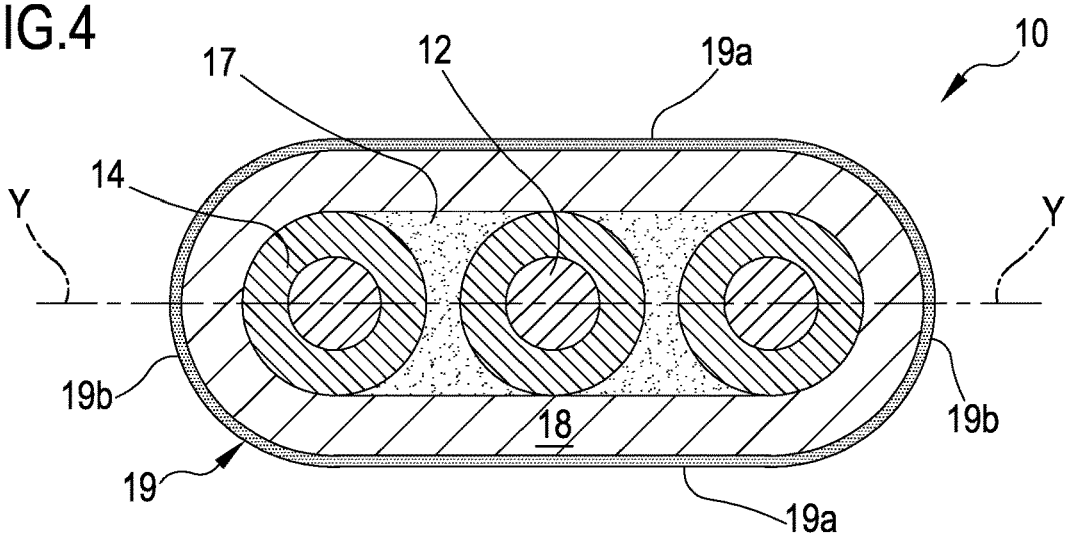
FIG. 4 is a cross-sectional view of the electric cable of FIG. 3.

With reference to FIGS. 3-4, a further embodiment of the cable 10 according to the invention will now be illustrated.

In the following description and in such figures, the elements of the cable 10 which are structurally and functionally equivalent to those described above with reference to the embodiment shown in FIGS. 1 and 2 will be indicated with the same reference numbers and will not be further described.

In the preferred embodiment illustrated in FIGS. 3-4, the cable 10 is a flat cable comprising three cores 11 disposed in a mutual planar configuration.

All the cores 11 lie substantially parallel in a common plane and adjacent one to the other. In a section of the cable 10 transversal with respect to the lengthwise direction thereof, the cores 11 lie substantially centred on a common transversal plane "Y-Y".

In this embodiment of the cable 10, the outer armor 19 presents two substantially flat sides 19*a* parallel to the above cited common plane Y-Y and two opposite curved sides 19*b* surrounding a portion of two lateral cores 11.

Similarly to the preceding embodiment, the outer armor 19 preferably comprises a carbon steel tape 20 wound according to short-pitch helical interlocked windings and comprising an aluminum coating layer 22 applied on both surfaces and on the edges thereof.

Similarly to the preceding embodiment, the aluminum coating layer 22 preferably comprises silicon.

As illustrated in FIG. 5, an intermetallic layer 21 preferably made of an alloy which comprises a Fe—Al—Si intermetallic compound is also in this case formed at an interface between the steel tape 20 and the aluminum coating layer 22.

FIGS. 1-5 show just two possible embodiments of a cable according to the present invention: it is obvious that modifications known in the art can be made to these embodiments, while still remaining within the scope of the present invention.

The present invention is further described in the following examples, which are merely for illustration and must not be regarded in any way as limiting the invention.

EXAMPLE 1

In order to evaluate the hydrogen sulfide corrosion and cracking resistance of Al-coated carbon steel tapes to be used for building the outer armor of a cable according to the present invention, specimens of carbon steel tapes were subjected to a first ageing test act according to NACE Standard TM0177-96 sulfide stress corrosion cracking (SSCC) test specifications.

The Al-coated carbon steel tapes were obtained as described above by hot dip coating a carbon-manganese steel tape in a bath containing aluminum which comprises silicon (10% wt).

The thickness of the aluminum coating layer was of about 30 μm, while the thickness of the intermetallic layer comprising a Fe—Al—Si intermetallic compound was of about 5 μm.

In the test carried out, the Fe—Al—Si intermetallic compound in the intermetallic layer was determined to have the formula $Al_{5.3}SiFe_{1.5}$.

The tests were made under the following conditions:

Preloading of the specimens by deflection method, with comparator

Test solution: A of EFC 16 (European Federation of Corrosion)

pH solution: 3.8-4.2

Volume/surface ratio: 30 $cm^3/cm^2$

Gas test: 10% wt $H_2S$+90% wt $CO_2$ or 100% wt $H_2S$

Stress level: 90% of AYS (average yield stress)

Visual exam on every specimen, after corrosion test

The opposite ends of the aluminum coated carbon steel tapes were protected with epoxy paint.

The specimens were preloaded according to the NACE standard specifications and submerged in test solutions at saturation phase.

The parameters for the SSCC test are summarized in the following Table 1.

TABLE 1

| loading | Four point bending | Maximum stress 90% $Y_{\sigma 0,2\%}$ |
|---|---|---|
| Gas | 10% wt $H_2S$ | 90% wt $CO_2$ |
| | 100% wt $H_2S$ | — |
| Duration | 720, 1440, 2160, 3000, and 4320 hours | |

The tested specimens were: aluminum coated carbon steel tapes and comparative uncoated carbon steel tapes as specified in Table 2 below.

Specifically, the specimens were submerged in the test solution containing a gas formed by 10% wt $H_2S$+90% wt $CO_2$ in water at room temperature.

In Table 2 below the ageing test details for a NACE Standard TM0177-96 SSCC test with a gas formed by 10% wt $H_2S$+90% wt $CO_2$ and results are listed.

TABLE 2

| Sample | No. of samples | Size** (mm) | Hours | Examination | RESULT |
|---|---|---|---|---|---|
| Aluminum coated strip | | | | | |
| 1 | 2 | 120 × 7 × 2 | 720 | No failure - no cracks | PASS |
| 1 | 1 | 120 × 7 × 2 | 1440 | No failure - no cracks | PASS |
| 1 | 1 | 120 × 7 × 2 | 3000 | No failure - no cracks | PASS |
| 2 | 6 | 200 × 7 × 2 | 720 | No failure - no cracks | PASS |
| 2 | 3 | 200 × 7 × 2 | 1440 | No failure - no cracks | PASS |
| 2 | 3 | 200 × 7 × 2 | 2160 | No failure - no cracks | PASS |
| 3 | 1 | 150 × 7 × 2 | 4320 | No failure - no Cracks | Pass |
| Uncoated steel | | | | | |
| 1* | 2 | 120 × 7 × 2 | (720) | Failure ≤480 hours hydrogen induced cracking | NO PASS |
| 2* | 3 | 200 × 7 × 2 | (720) | | NO PASS |

*= comparative
**length × width × thickness

After just 480 hours of ageing, the comparative uncoated steel tapes were already wrecked.

At the end of the ageing test the solution was dirty, as a result of the corrosion of the comparative uncoated specimens.

Differently, at the end of the ageing test the aluminum coated specimens according to the invention were substantially unharmed and their solution was clear, a sign of the protective action exerted by the aluminum.

In Table 3 below the ageing test details for a NACE Standard TM0177-96 SSCC test with 100% wt $H_2S$ and results are listed for Al-coated carbon steel tapes according to the present invention.

TABLE 3

| Sample | No. of samples | Size** (mm) | Hours | Examination | RESULT |
|---|---|---|---|---|---|
| Aluminum coated strip | | | | | |
| 1 | 2 | 120 × 7 × 2 | 720 | No failure - no cracks | PASS |
| 2 | 2 | 200 × 7 × 2 | 1440 | No failure - no cracks | PASS |

**length × width × thickness

The coated samples remained substantially unharmed after prolonged contact with a 100% wt hydrogen sulfide gas solution.

EXAMPLE 2

To verify the adhesion characteristics of the Al coating layer to the carbon steel tape a three point bending test was carried out. Aluminium coated steel tapes according to the invention (0.625 mm×120 mm; aluminium coating thickness: 30 μm) were bent to 70°, 90° or 180° with corresponding plastic deformation up to 30% (external) and 68% (internal). None of the tested samples showed detachment of or cracking in the aluminium coating.

EXAMPLE 3

A steel tape (0.625 mm×120 mm) hot dip coated with aluminium containing 10 wt % of silicon according to the invention was observed by energy dispersive spectroscopy (EDS) for elemental analysis.

Figure 6:
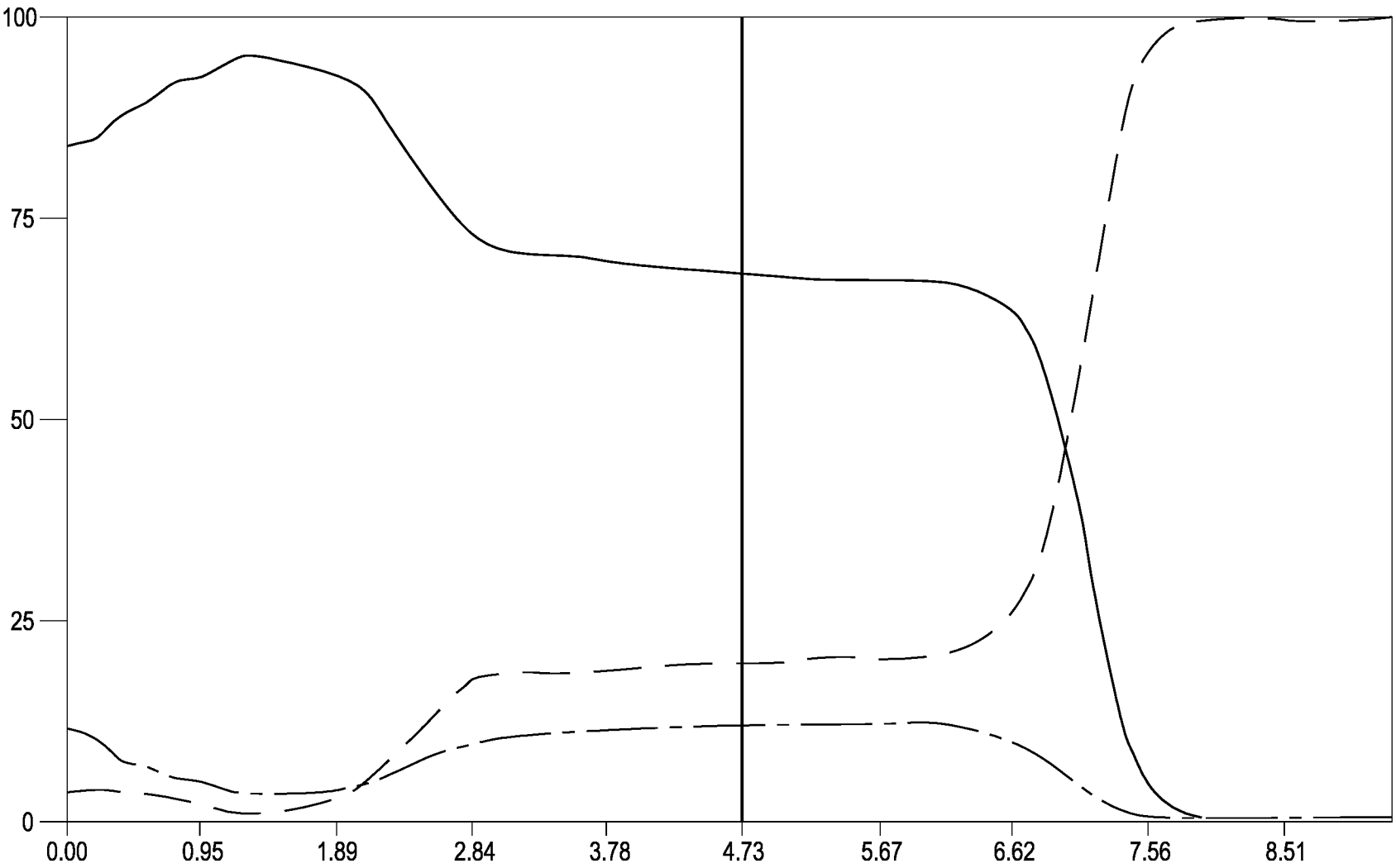
FIG. 6 is a graph of an energy dispersive spectroscopy (EDS) elemental analysis of an intermetallic compound at the interface between the steel tape and the aluminum coating layer.

FIG. 6 shows the result of the analysis of a section at the interface between the steel tape (on the right side) and the aluminium coating (on the left side). In such a figure, the % of element concentration is reported in ordinate and the thickness in microns is reported in abscissae starting from the aluminium coating.

In a region of about 4.73 μm on both sides of the median plane (shown with a thickened vertical line in FIG. 6) of an interface layer (having a total thickness of about 9.46 μm), an intermetallic compound, containing aluminium (continuous line), silicon (dashed line) and iron (dotted line), is present in significant amounts.

The invention claimed is:

1. An electric cable comprising:

a cable core comprising a power transmissive insulated element; and a metallic outer armor containing the cable core;

wherein the outer armor comprises a carbon steel tape wound according to helical interlocked windings, the tape being coated with an aluminum coating layer comprising aluminum and having a thickness ranging from 20 μm to 45 μm, and wherein the cable further comprises a Fe—Al—Si intermetallic compound at an interface between the steel tape and the aluminum coating layer, the intermetallic compound being included within an interface layer having a thickness of 2 μm to 7 μm and having the formula:

$Al_xSiFe_y$ wherein x is a number of 3 to 7 and y is a number of 1 to 3.

2. The electric cable according to claim 1, comprising an Al—Fe intermetallic compound at said interface between the steel tape and the aluminum coating layer.

3. The electric cable according to claim 1, wherein the aluminum coating layer of the carbon steel tape of the outer armor comprises silicon.

4. The electric cable according to claim 3, wherein the aluminum coating layer comprises from 5 to 15% by weight of Si based on a total weight of the aluminum coating layer.

5. The electric cable according to claim 1, wherein the Fe—Al—Si intermetallic compound has the formula:

$Al_{5.3}SiFe_{1.5}$.

6. The electric cable according to claim 1, wherein the carbon steel tape has a thickness of 550 μm to 750 μm.

7. An electric cable comprising:

a cable core comprising a power transmissive insulated element; and a metallic outer armor containing the cable core;

wherein the outer armor comprises a carbon steel tape wound according to helical interlocked windings, the tape being coated with an aluminum coating layer comprising aluminum and having a thickness ranging from 20 μm to 45 μm and wherein a Fe—Al—Si intermetallic compound exists at an interface between the steel tape and the aluminum coating layer, wherein the Fe—Al—Si intermetallic compound has the formula:

$Al_xSiFe_y$ wherein x is a number of 3 to 7 and y is a number of 1 to 3.

8. The electric cable according to claim 7, wherein the aluminum coating layer of the carbon steel tape of the outer armor comprises silicon.

9. The electric cable according to claim 8, wherein the aluminum coating layer comprises from 5 to 15% by weight of Si based on a total weight of the aluminum coating layer.

10. The electric cable according to claim 7, wherein the Fe—Al—Si intermetallic compound has the formula:

$Al_{5.3}SiFe_{1.5}$.

11. The electric cable according to claim 7, wherein the carbon steel tape has a thickness of 550 μm to 750 μm.

* * * * *